US005336548A

United States Patent [19]

Shiokawa et al.

[11] Patent Number: 5,336,548

[45] Date of Patent: Aug. 9, 1994

[54] MULTIPLE-USE THERMAL IMAGE TRANSFER RECORDING MEDIUM

[75] Inventors: Keiichi Shiokawa, Numazu; Mihoko Akiyama, Susono; Yoji Ide, Mishima; Yoshihiko Hiyoshi; Masahiro Sato, both of Shizuoka; Kumi Surizaki, Numazu, all of Japan

[73] Assignee: Ricoh Company, Ltd., Tokyo, Japan

[21] Appl. No.: 992,041

[22] Filed: Dec. 17, 1992

[30] Foreign Application Priority Data

Dec. 19, 1991 [JP] Japan ..... 3-355099
Jun. 16, 1992 [JP] Japan ..... 4-181724

[51] Int. Cl.[5] ..... B41M 5/26

[52] U.S. Cl. ..... 428/212; 428/195; 428/318.4; 428/323; 428/484; 428/488.1; 428/488.4; 428/913; 428/914

[58] Field of Search ..... 428/195, 212, 484, 488.1, 428/488.4, 913, 914, 318.4, 323

[56] References Cited

FOREIGN PATENT DOCUMENTS 62-62790 3/1987 Japan ..... 428/488.1
63-151483 6/1988 Japan .

*Primary Examiner*—Pamela R. Schwartz
*Attorney, Agent, or Firm*—Oblon, Spivak, McClelland, Maier & Neustadt

[57] ABSTRACT

A multiple-use thermal image transfer recording medium is composed of a heat-resistant support, a thermal image transfer layer formed on the heat-resistant support, which thermal image transfer layer is composed of a plurality of thermofusible ink layers overlaid on the heat-resistant support, and a porous resin layer formed on the thermal image transfer layer. The thermal image transfer layer contains a thermofusible ink component containing as the main components a coloring agent and a thermofusible material. The melt viscosity of the thermofusible ink component in each of the thermofusible ink layers is in such a relationship that the melt viscosity increases toward the heat-resistant support.

13 Claims, 2 Drawing Sheets

MULTIPLE-USE THERMAL IMAGE TRANSFER RECORDING MEDIUM

BACKGROUND OF THE INVENTION

1. Field of the Invention

This invention relates to a multiple-use thermal image transfer recording medium, capable of yielding images with high density which is maintained during the multiple use thereof.

2. Discussion of Background

Recording apparatus, such as a printer and a facsimile apparatus, using a thermal image transfer recording method, is now widely used. This is because the recording apparatus of this type is relatively small in size and can be produced inexpensively, and the maintenance is simple.

In a conventional thermal image transfer recording medium for use with the thermal image transfer recording apparatus, a single thermofusible ink layer is merely formed on a support. When such a recording medium is used for printing images, the heated portions of the ink layer are completely transferred to an image-receiving sheet at only one-time printing, so that the recording medium can be used only once, and can never be used repeatedly. The conventional recording medium is thus disadvantageous from the viewpoint of running cost.

In order to overcome the above drawback in the prior art, there have been proposed the following recording medium:

(1) A microporous ink layer containing a thermofusible ink is formed on a support so that the ink can gradually ooze out from the ink layer as disclosed in Japanese Laid-Open Patent Applications 54-68253 and 55-105579;

(2) A porous film is provided on an ink layer formed on a support so that the amount of an ink which oozes out from the ink layer can be controlled as disclosed in Japanese Laid-Open Patent Application 58-212993; and (3) A plurality of adhesive layers and a plurality of ink layers are overlaid in turn on a support so that an ink layers can be gradually exfoliated in the form of thin layer when images are printed as disclosed in Japanese Laid-Open Patent Applications 60-127191 and 60-127192.

However, after the above-mentioned thermal image transfer recording medium (1) is repeatedly employed, the ink does not flow smoothly from the ink layer and the density of the obtained images gradually decreases.

When the diameter the pores of the porous film is increased in the case of the above-mentioned thermal image transfer recording medium (2) to increase the density of the images, the mechanical strength of the recording medium is lowered and the ink layer peels away from the support. Furthermore, in the case of the thermal image transfer recording medium (3), there is the shortcoming that the amount of the thermofusible ink contained in the ink layer which is transferred is not uniform for each printing operation.

Furthermore, most of the conventional methods have been developed in such a fashion as to be suitable for use with a serial thermal head in a recording apparatus such as a word processor. Therefore, when those methods are applied to a line thermal head for use in recording apparatus such as a facsimile apparatus and a bar code printer, problems such as the exfoliation of an ink layer, and the decrease of image density are inevitable because the time elapsed before the thermal image transfer recording medium is separated from an image-receiving sheet is relatively long after the image transfer recording medium is brought into contact with the image-receiving sheet under application of heat thereto. In the conventional thermal image transfer recording media, there has been another proposal that an intermediate adhesive layer comprising a thermofusible resin be interposed between a support and an ink layer in order to prevent the exfoliation of the ink layer from the support as disclosed in Japanese Laid-Open Patent Application 63-137891. In this case, however, heat loss during the thermal image transfer recording is increased by the provision of the intermediate adhesive layer. Accordingly, when the intermediate adhesive layer is employed for a multiple-use thermal image transfer recording medium which is thicker than the thermal image transfer recording medium which can be used only once, the thermosensitivity thereof is considerably decreased. In order to obtain satisfactory thermosensitivity, it is necessary to decrease the amount of ink coated or to increase the energy applied to the multiple-use thermal image transfer recording medium.

SUMMARY OF THE INVENTION

Accordingly, an object of this invention is to provide a multiple-use thermal image transfer recording medium capable of repeatedly yielding images with high density, with a minimum decrease thereof, from which an almost uniform amount of ink is transferred to an image-receiving sheet at each printing even after multiple thermal image transfers, without the occurrence of the complete transfer of a thermal image transfer layer to the image-receiving sheet when the image transfer recording medium is separated from the image-receiving sheet after the image transfer operation.

This object of the present invention can be attained by a multiple-use thermal image transfer recording medium comprising a heat-resistant support, a thermal image transfer layer formed on the heat-resistant support; the thermal image transfer layer comprising a plurality of thermofusible ink layers, which is overlaid on the heat-resistant support and comprises a thermofusible ink component comprising as the main components a coloring agent and a thermofusible material, the melt viscosity of the thermofusible ink component in each of the thermofusible ink layers being in such a relationship that the melt viscosity increases toward the heat-resistant support; and a porous resin layer formed on the thermal image transfer layer.

The object of the present invention can also be attained by a multiple-use thermal image transfer recording medium comprising a heat-resistant support; a thermal image transfer layer formed on the heat-resistant support, the thermal image transfer layer comprising a plurality of thermofusible ink layers, which is overlaid on the heat-resistant support and comprises a thermofusible ink component comprising as the main components a coloring agent and a thermofusible material, the melt viscosity of the thermofusible ink component in each of the thermofusible ink layers being in such a relationship that the melt viscosity increases toward the heat-resistant support, and the thermofusible ink layer in contact with the heat-resistant support having adhesive properties to the heat-resistant support; and a porous resin layer formed on the thermal image transfer layer.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE PREFERRED EMBODIMENTS

Figure 1:
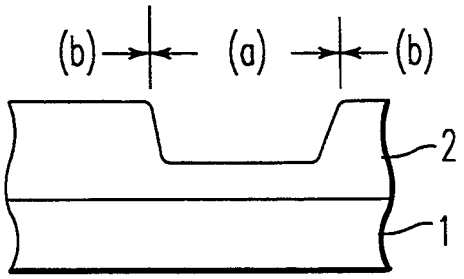
FIG. 1 is a schematic partial cross-sectional view of a multiple-use thermal image transfer recording medium showing the state of the thermal image transfer ink layer after multiple-use thereof, employed in the course of the technical analysis for the present invention.

A first multiple-use thermal image transfer recording medium according to the present invention comprises a heat-resistant support, a thermal image transfer layer formed on the heat-resistant support, and a porous resin layer formed on the thermal image transfer layer. The thermal image transfer layer comprises a plurality of thermofusible ink layers, and comprises a thermofusible ink component comprising as the main components a coloring agent and a thermofusible material. The melt viscosity of the thermofusible ink component in each of the thermofusible ink layers is in such a relationship that the melt viscosity increases toward the heat-resistant support. The thermofusible ink layer in contact with the heat-resistant support has adhesive properties to the heat-resistant support.

Multiple thermal image transfers can be performed by the application of heat to at least an identical portion of the multiple-use thermal image transfer recording medium of the present invention in which the identical portion of the thermal image transfer layer is transferred to an image-receiving sheet. High density images can be printed with a minimum decrease in density thereof even by repeated use of the multiple-use thermal image transfer recording medium of the present invention.

The melt viscosity of the thermofusible ink component in the thermal image transfer layer can be adjusted by adding a viscosity bodying agent thereto, and appropriately selecting the kind of the viscosity bodying agent and the amount thereof. As the viscosity bodying agent, an adhesive material or a tacky material which assume a solid state at room temperature can be employed.

Specific examples of the viscosity bodying agent are polymers such as rosin, polyterpene, petroleum resin, and hydrogenated materials derived from these; organic materials with a high melt viscosity such as microcrystalline wax.

In the present invention, it is preferable that ethylene-vinyl acetate copolymer be employed as the viscosity bodying agent, more preferably ethylene-vinyl acetate copolymer with a melt flow rate (MF) of 10 g/10 min or more, and most preferably ethylene-vinyl acetate copolymer with a melt flow rate of 100 g/10 min or more measured in accordance with JIS K 6760.

In the multiple-use thermal image transfer recording medium according to the present invention, it is preferable that the melt viscosity at 110° C. of a first thermofusible ink layer (A), which is in contact with the heat-resistant support, be in the range of 1,000 to 300,000 cps, and that the melt viscosity at 110° C. of a second thermofusible ink layer (B), which is in contact with the porous resin layer, be in the range of 100 to 10,000 cps. Moreover, it is preferable that the ratio (A)/(B) of the melt viscosity of the first thermofusible ink layer (A) to the melt viscosity of the second thermofusible ink layer (B) be adjusted to 5or more, and more preferably in the range of 10 to 30.

When the thermal image transfer layer is composed of three or more thermofusible ink layers, the melt viscosity of the thermofusible ink component is adjusted in each of the thermofusible ink layers in such a manner that the melt viscosity decreases from the heat-resistant support side toward the porous resin layer.

Materials with a releasability with respect to the thermofusible ink component are preferably employed as the material for the porous resin layer in the present invention, although conventional resins can be employed.

Since the viscosity gradient of the thermofusible ink component has the above-mentioned relationship, an image with high density can be produced at each image transfer operation by use of the multiple-use thermal image transfer recording medium according to the present invention. The reason for this will now be described with reference to FIG. 1.

FIG. 1 is a schematic partial cross-sectional view of a multiple-use thermal image transfer recording medium showing the state of the thermal image transfer ink layer which was employed for the technical analysis for the present invention after multiple-use thereof. The multiple-use thermal image transfer recording medium in FIG. 1 comprises a support 1, and an ink layer 2 formed on the support 1. The amount of the thermofusible ink component is small in the portion (a) in comparison with the other portion (b), since the thermofusible ink component in the portion (a) is employed for thermal image transfer a multiple number of times.

In the case where the thermal image transfer recording is performed in such a state as shown in FIG. 1, a larger amount of energy is applied to the thermofusible ink component per unit volume in the portion (a) than in the portion (b). Therefore, the fluidity of the thermofusible ink component in the portion (a) is increased. When the melt viscosity of the thermofusible ink component is low, the flow rate of the ink component is high and the amount of the ink component transferred to an image-receiving sheet is increased. On the contrary, when the melt viscosity of the thermofusible ink component is high, the flow rate of the ink component becomes low and the amount of the thermofusible ink component transferred to the image-receiving sheet is decreased.

In the multiple-use thermal image transfer recording medium according to the present invention, the melt viscosity of the thermofusible ink component in each of the thermofusible ink layer increases toward the heat-resistant support. Accordingly, the smaller the amount of the thermofusible ink component on the heat-resistant support, the higher the melt viscosity of the ink component. Thus, the thermofusible ink component does not flow faster than required. When the amount of the thermofusible ink on the heat-resistant support is decreased in the thermal image transfer recording medium of the present invention after repeated image transfer operations, the amount of ink transferred to the image-receiving sheet is not increased, and the amount of thermofusible ink in the obtained image can constantly be maintained.

As a result, images with excellent density can be obtained at each of the multiple thermal image transfer recording operations.

In order to fabricate the multiple-use thermal image transfer recording medium according to the present invention, thermofusible ink layers are successively coated on the heat-resistant support and dried in the order from the thermofusible ink layer comprising a thermofusible ink component with a low melt viscosity to the layer comprising a thermofusible ink component with a high melt viscosity, and a porous resin layer is overlaid on the thermofusible ink layers.

Examples of the material for the porous resin layer are a various kinds of resins with a grass transition temperature higher than the melting point of the thermofusible ink component in the thermal image transfer layer such as vinyl chloride resin, vinyl chloride-vinyl acetate copolymer, polyester resin, epoxy resin, polycarbonate resin, phenolic resin, polyamide resin, cellulose resin, polyimide resin, and acrylic resin. It is preferable that the porous resin layer be formed by use of resins having a releasability with respect to the thermofusible ink component in the thermal image transfer layer, or by a mixture of each of the above-mentioned resins and a material with releasability.

Examples of the resin used for the formation of the porous resin layer include low-surface-energy resins such as silicone resin, modified silicone resin, fluorocarbon resin, and modified fluorocarbon resin. These resins can be used alone or in combination. Examples of the modified silicone resin and the fluorocarbon resin are conventionally known acryl modified resin, urethane modified resin, alkyd modified resin and epoxy modified resin.

Each of the above-mentioned modified resins constitutes a low-surface-energy resin in which a polyorganosiloxane portion; a fluoroethylene portion such as difluoroethylene, trifluoroethylene, or terfluoroethylene; or a fluorinated hydrocarbon portion with low surface energy is bonded to each of the modified resins by block-copolymerization, or grafted-copolymerization.

Furthermore, the porous resin layer with releasability can be formed by a mixture of a low-surface-energy material and a generally used-conventional resin. Examples of the low-surface-energy material include the above-mentioned low-surface-energy resins and a low-surface-energy organic material compatible with the resin such as fluorinated hydrocarbon. The resin used for preparation of the porous resin layer can be selected from many kinds of resins with a glass transition temperature higher than the melting point of the thermofusible ink component. Examples of the resins are vinyl chloride, vinyl chloride-vinyl acetate copolymer, polyester resin, epoxy resin, polycarbonate resin, phenolic resin, polyimide resin, cellulose resin, polyamide resin, and acrylic resin.

The porous resin layer is formed in accordance with a conventional method. For instance, a solution is made of a mixture of the above-mentioned resin and a low-surface-energy resin or a low-surface-energy material. Then, a dispersion obtained by dispersing a thermofusible solid material in water or an organic solvent in the form of finely-divided particles is added to the above prepared solution. The thus obtained mixture is coated on a thermal image transfer layer and dried, whereby a porous resin layer is formed on the thermal image transfer layer.

Examples of the thermofusible material preferably used in the present invention are a variety of thermofusible materials, such as waxes which assume the solid state at room temperature such as waxes. The diameter of the pores of the porous resin layer and the density thereof can be adjusted by changing the size and amount of the dispersed particles of the thermofusible material. It is preferable that the mixing ratio by weight of the thermofusible material to the resin be in the range of (10:90) to (80:20). Moreover, it is preferable that the amount of the porous resin coating layer be 0.05 to 0.5 $g/m^2$ on a dry basis.

The porous resin layer is made releasable with respect to the thermofusible ink component. Therefore, the thermofusible ink component fused in the course of the thermal image transfer is easily transferred to an image-receiving sheet, and the amount of the thermofusible ink component transferred can be controlled. Furthermore, the peel strength of the thermal image transfer recording medium and the image-receiving medium after the image transfer operation is preferably minimized.

In the case where the images are transferred onto an image-receiving sheet by use of the thermal image transfer recording medium of the present invention, the obtained images are clear because of the uniform transfer of the thermofusible ink component to the image-receiving sheet. In addition to the above, the complete transfer of the thermal image transfer layer, which is peeled off the support, to an image-receiving sheet is prevented when the thermal image transfer recording medium is separated from the image-receiving sheet after the thermal image transfer. It is preferable that the peel strength between the porous resin layer and the thermofusible ink component in the thermal image transfer layer at 40° C. be in the range of about 0.5 to 2.0 gf/cm.

Figure 4:
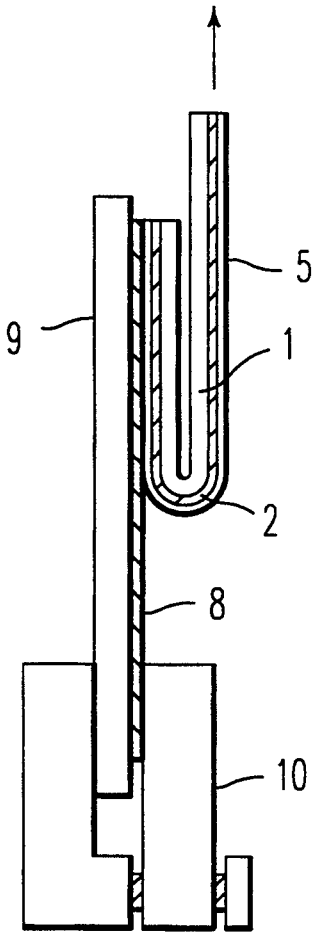
FIG. 4 is a schematic diagram in explanation of the measurement of the peel strength of a thermofusible ink layer of a thermal image transfer recording medium of the present invention by use of a tensilon tensile and compression tester.

FIG. 4 is a schematic vertical cross-sectional view of a commercially available tensilon tensile and compression tester, "TCM-200 CR Type" (Trademark), made by Minebea Co., Ltd. for measuring the peel strength of the thermal image transfer layer of such thermal image transfer recording media as mentioned above.

In FIG. 4, a "Peach Coat paper" (Trademark), made by Nissinbo Industries, is applied to a porous resin layer 5 overlaid on the thermal image transfer layer 2. A heat-resistant support 1 is formed on the thermal image transfer layer 2. Reference numeral 9 indicates a reinforcement plate on which the Peach Coat paper 8 is placed. In this case, a thick stainless steel plate is employed as the reinforcement plate 9. Reference number 10 indicates a securing member.

The peel strength of the thermal transfer ink layer 2 was measured by bringing the porous resin layer 5 into contact with the Peach Coat Paper 8 under application of heat at 100° C. and pressure of 1 $kg/cm^2$ for one sec thereto by using a hot stamp, followed by peeling the thermal image transfer recording medium off the Peach Coat Paper 8 at a uniform peeling speed under the following conditions:

Peeling Angle: 180°
Peeling Speed: 50 mm/min
width of the Test Piece: 10 mm
Ambient Temperature: 40° C. (dry)

The above-mentioned peel strength is the force applied to the thermal image transfer recording medium at the commencement of the peeling of the thermal image transfer recording medium from the Peach Coat paper 8 in such a manner that only the thermofusible ink component flows out through the porous resin layer 5 and remains on the Peach coat paper 8.

A second multiple-use thermal image transfer recording medium of the present invention comprises a heat-resistant support, a thermal image transfer layer formed on the heat-resistant support, comprising a plurality of thermofusible ink layers, which is overlaid on the heat-resistant support, and a porous resin layer formed on the thermal image transfer layer.

The thermal image transfer layer for use in the present invention comprises a thermofusible ink component comprising as the main components a coloring agent and a thermofusible material. The melt viscosity of the thermofusible ink component in each of the thermofusible ink layers is in such a relationship that the melt viscosity increases toward the heat-resistant support. Furthermore, the thermofusible ink layer in contact with the heat-resistant support has adhesive properties to the heat-resistant support.

The complete transfer of the thermal image transfer layer is prevented by use of this multiple-use thermal image transfer recording medium. The adhesive properties can be imparted to the thermal image transfer layer with respect to the heat-resistant support by adding a tacky material or adhesive material to the thermofusible ink layer which is in contact with the heat-resistant support.

Examples of the above-mentioned tacky material or adhesive material are polymeric materials and waxes.

Specific examples of the material include polymeric adhesive agent such as ethylene-vinyl acetate copolymer and ethylene-ethyl acrylate copolymer, and microcrystalline wax.

The amount of such a tacky material or adhesive material added is appropriately selected in accordance with the frequency of the printing operation and the printing conditions. When the multiple-use thermal image transfer recording medium according to the present invention is applied to a line thermal head built-in printer, it is preferable that the polymeric adhesive agent be used in an amount in the range of 5 to 50 wt % of the thermal image transfer layer. When the microcrystalline wax is employed as the tacky material or adhesive material, it is preferable that the amount used be in the range of 5 to 70 wt %. When the amount of the polymeric adhesive agent added to the thermal image transfer layer is in the above-mentioned preferable range, images with excellent density can be obtained without decreasing the adhesive strength of the thermal image transfer layer to the heat-resistant support. On the other hand, when an amount of microcrystalline wax in the above-mentioned range is employed, the adhesive strength of the thermal image transfer layer to the support is maintained and the blocking problem is avoided.

It is preferable that the adhesive strength between the thermal image transfer layer and the heat-resistant support at 40° C. be in the range of about 5 to 50 gf/cm.

The adhesive strength between the thermal image transfer layer and the heat-resistant support can be measured in accordance with the following method:

The adhesive strength between the thermal image transfer layer and the heat-resistant support was measured by applying a test piece of the thermal image transfer recording medium to an adhesive tape including an adhesive layer which is commercially available from Nichiban Co., Ltd. in such a manner that the ink layer was in contact with the adhesive layer of the adhesive tape, and then peeling the thermal image transfer recording medium from the adhesive layer under the following conditions:

Measuring apparatus: "TCM-200 CR Type"
Peeling Angle: 180°
Peeling Speed: 50 mm/min
Width of the Test Piece: 10 mm
Ambient Temperature: 40° C.

The adhesion strength is the force applied to the thermal image transfer recording medium after the commencement of the peeling of the thermal image transfer recording medium from the adhesive tape in such a manner that the thermofusible ink layers remain on the adhesive tape.

The coloring agent contained in the thermal image transfer layer of the present invention can be selected from conventionally known pigments and dyes. Of the known pigments, carbon black and phthalocyanine pigments are preferably used. Among the known dyes, direct dyes, acid dyes, basic dyes, disperse dyes and oil-soluble dyes are preferably used.

Examples of the thermofusible material contained in the thermal image transfer layer include natural waxes such as beeswax, carnauba wax, whale wax, Japan wax, candelilla wax, rice bran wax, and montan wax; paraffin wax; polyethylene wax; oxidized wax; ozocerite; ceresine wax; and ester wax. In addition to the above, higher fatty acids such as margaric acid, lauric acid, myristic acid, palmitic acid, stearic acid, fromic acid and behenic acid; higher alcohols such as stearyl alcohol and behenyl alcohol; higher fatty amides such as stearic amide and oleic amide; and esters such as sorbitan fatty acid ester can also be employed.

The coating amount for providing the thermal image transfer layer is appropriately decided with many factors such as the frequency of the printing operation and the thermosensitivity of the recording medium taken into consideration. In general, It is desirable that the coating amount of the thermal image transfer layer be 4 to 12 g/m$^2$ on a dry basis in its entirety. More specifically, when the thermal image transfer layer for use in the present invention is composed of two thermofusible ink layers, each layer is coated in an amount of about 2 to 7 g/m$^2$, while when the thermal image transfer layer is composed of three layers, each layer is coated in an amount of about 2 to 5 g/m$^2$.

In the first and second multiple-use thermal image transfer recording media according to the present invention, it is highly preferable that the thermofusible material, at least in the thermofusible ink layer which is in contact with the porous resin layer, be in the form of finely-divided particles. With the above recording medium, the thermosensitivity thereof is increased. The thermofusible ink component in the form of finely-divided particles is easily fused even by the application of a small amount of heat thereto, flows out through the porous resin layer, and is transferred to an image-receiving sheet.

By using finely-divided particles of the thermofusible material in the thermofusible ink layer, minute voids are formed in the thermofusible ink layer, thereby providing a heat-insulating effect. Thermosensitivity of the multiple-use thermal image transfer recording medium is increased since heat energy applied to the recording medium from a thermal head is prevented from being transmitted an image-receiving sheet, and the heat energy is used to efficiently fuse the thermofusible ink component in the thermofusible ink layer.

It is preferable that the thermofusible material in the form of finely-divided particles have an average particle diameter in the range of 1.0 to 10.0 μm. When the average particle diameter is in the range of 1.0 to 10.0 μm, sufficient voids are produced in the thermal image transfer layer to exhibit a heat-insulating effect, and the thermofusible finely-divided particles are easily fused.

The average particle diameter of the finely-divided particles of the thermofusible material for use in the present invention is calculated by measuring the particle diameters of the thermofusible material in a cross section of each ink layer by observing The cross section with a transmission-type electron microscope (TEM). The particle sizes of the thermofusible material observed by the TEM are approximately equal to the particles sizes of the thermofusible material dispersed in thermofusible ink layer coating liquid. Therefore, the particle diameters of the thermofusible material in the thermofusible ink layers can be appropriately adjustable at the stage of preparing the coating liquids for thermofusible ink layer coating liquids. The particle size of the thermofusible material in such coating liquids can be easily measured by a laser scattering particle size distribution analyzer "LA-700" (Trademark), made by Horiba Ltd.

The thermofusible material in the form of finely-divided particles can be prepared by dispersing the thermofusible material for use in the present invention in accordance with a conventionally known solvent dispersion or emulsion dispersion method. Finely-divided thermofusible particles with the previously mentioned required average particle diameter can be easily obtained by selecting the appropriate combination of a good solvent and a bad solvent for the thermofusible material to be used.

For instance, lanolin monoglyceride with a melting point of 73° C. is soluble in toluene, but is not easily dissolved in methyl ethyl ketone. When the lanolin monoglyceride is dispersed in a mixture of toluene and methyl ethyl ketone in a mixing ratio of (1:3) using a ball mill, a dispersion containing the lanolin monoglyceride particles with an average particle diameter in the range of 6.0 to 8.0 μm can be obtained. The thermofusible ink component comprising as the main components a coloring agent and the above-mentioned dispersion is coated onto the heat-resistant support or the thermofusible ink layer which is in contact with or close to the heat-resistant support and dried at a temperature lower than the melting point of the thermofusible finely-divided particles, so that a thermofusible ink layer comprising the thermofusible material in the form of finely-divided particles for use in the present invention can be obtained.

The heat-resistant support can be made of a conventional heat-resistant material, for example, a plastic film such as polyester, polycarbonate, triacetyl cellulose; nylon, and polyimide; cellophane; parchment paper; and condenser paper. It is preferable that the heat-resistant support have a thickness of about 2 to 15 μm, with the thermosensitivity of the multiple-use thermal image transfer recording medium and the mechanical strength thereof taken into consideration.

Moreover, a heat-resistant protective layer may be formed on the surface of heat-resistant support which is to be in contact with a thermal head, to further improve heat-resistance of the heat-resistant support.

Examples of the material for the heat-resistant protective layer include silicone resin, fluorocarbon resin, polyimide resin, epoxy resin, phenolic resin, melamine resin and nitrocellulose.

Figure 2:
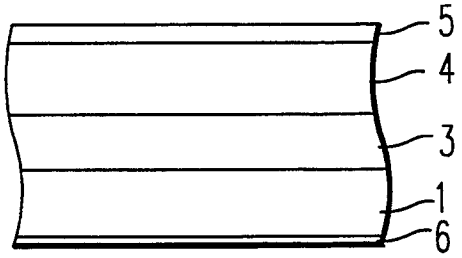
FIG. 2 is a schematic partial cross-sectional view of an example of a multiple-use thermal image transfer recording medium according to the present invention.

FIG. 2 is a schematic partial cross-sectional view of an example of a multiple-use thermal image transfer recording medium according to the present invention. In the figure, a first thermofusible ink layer 3 is formed on a heat-resistant support 1, a second thermofusible ink layer is formed on the first thermofusible ink layer 3, and a porous resin layer 5 is overlaid on the second thermofusible ink layer 4. A heat-resistant protective layer 6 is formed on the heat-resistant support 1, opposite to the first thermofusible ink layer 3.

In the multiple-use thermal image transfer recording medium according to the present invention, the melt viscosity of the thermofusible ink component in the first thermofusible ink layer 3 is higher than that of the thermofusible ink component in the second thermofusible ink layer 4. Images with excellent density can be obtained on an image-receiving sheet for each image transfer operation, even after multiple thermal image transfer, for the previously mentioned reason.

It is preferable that the first thermal image transfer layer 3 have satisfactory adhesive properties with respect to the heat-resistant support 1 in the multiple-use thermal image transfer recording medium of the prevent invention. It is also preferable that the porous resin layer 5, with which an image-receiving sheet is to be in contact, have releasability with respect to the thermofusible ink component in the thermal image transfer layer.

Because of the above-mentioned releasability, the multiple-use thermal image transfer recording medium can smoothly be separated from the image-receiving sheet after the image transfer operation. In addition, a predetermined amount of the thermofusible ink component is transferred to the image-receiving sheet, and complete transfer of the thermofusible ink layer to the image-receiving sheet can be prevented when the recording medium is separated from the image-receiving sheet.

Figure 3:
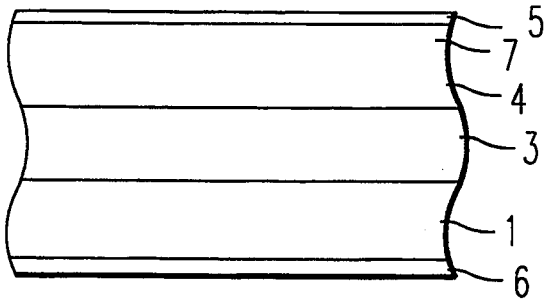
FIG. 3 is a schematic partial cross-sectional view of another example of a multiple-use thermal image transfer recording medium according to the present invention.

FIG. 3 is a schematic partial cross-sectional view of another example of a multiple-use thermal image transfer recording medium according to the present invention. The structure of the multiple-use thermal image transfer recording medium is the same as that shown in FIG. 2. In the case of FIG. 3, a thermofusible material in a second thermofusible ink layer 4 is in the form of finely-divided particles 7. In the multiple-use thermal image transfer recording medium with this structure, voids are formed in the second thermofusible ink layer 4 from the presence of the finely-divided particles 7 of the thermofusible material. Thus, the multiple-use thermal image transfer recording medium of the present invention has heat-insulating effect with improved thermosensitivity.

Other features of this invention will become apparent in the course of the following description of exemplary embodiments, which are given for illustration of the invention and are not intended to be limiting thereof.

EXAMPLE 1

Preparation of Coating Liquid A-1

The following components were placed in a sand mill vessel, and dispersed at 110° C., so that a coating liquid A-1 constituting a thermofusible ink component was obtained.

| | Parts by Weight |
|---|---|
| Carbon black | 15 |
| Lanolin monoglyceride (melting point: 73° C.) | 25 |
| Candelilla wax | 10 |
| Microcrystalline wax (melting point: 83° C.) | 40 |
| Ethylene-vinyl acetate copolymer (melt flow rate: 2,500 g/10 min) | 10 |

The melt viscosity at 110° C. of the above thermofusible ink component was 15,000 cps.

Preparation of Coating Liquid B-1

The following components were placed in a sand mill vessel, and dispersed at 110° C. to prepare a dispersion.

| | Parts by Weight |
|---|---|
| Carbon black | 10 |
| Candelilla wax | 30 |
| Lanolin monoglyceride | 60 |

The melt viscosity at 110° C. of the above prepared dispersion was 800 cps. 20 parts by weight of this dispersion was pulverized. 80 parts by weight of a mixture of methyl ethyl ketone and toluene at a mixing ratio of (2:1) were added to the above dispersion, and the dispersion was dissolved in the mixed solvent of methyl ethyl ketone and toluene with the application of heat. Subsequently, the mixture was cooled, and dispersed at 23° C. for 24 hours, whereby a coating liquid B-1 constituting a thermofusible ink component was obtained. The average particle diameter of the particles in the coating liquid B-1 was 5.5 μm.

Preparation of Coating Liquid C-1

The following components were mixed to prepare a mixture.

| | Parts by Weight |
|---|---|
| Vinyl chloride-vinyl acetate copolymer | 2 |
| 20% toluene solution of acryl-modified silicone resin | 1 |
| 30% water dispersion of carnauba wax (average particle diameter: 4 μm) | 8 |
| Methyl ethyl ketone | 89 |

The above prepared mixture was stirred to dissolve the vinyl chloride-vinyl acetate copolymer therein, and was further vigorously stirred, whereby a coating liquid C-1 was prepared.

Preparation of Multiple-use Thermal Image Transfer Recording Medium No. 1

One surface of a PET film with a thickness of 4.5 μm, serving as a support, was treated to have heat resistance. The aforementioned coating liquid A-1 was coated on the treated surface of the PET film by hot-melt coating, so that a first thermofusible ink layer in a coating amount of 3 g/m$^2$ was formed on the heat-resistant support.

Subsequently, the aforementioned coating liquid B-1 was coated on the above prepared first thermofusible ink layer using a bar coater and dried with the application of heat thereto at 60° C., so that a second thermofusible ink layer in a coating amount of 4 g/m$^2$ was formed on the first thermofusible ink layer.

The aforementioned coating liquid C-1 was coated on second thermofusible ink layer using a bar coater, so that a porous resin film layer in a coating amount of 0.3 g/m$^2$, was formed on the second thermofusible ink layer.

Thus, a multiple-use thermal image transfer recording medium No. 1 according to the present invention was obtained.

EXAMPLE 2

Preparation of Coating Liquid C-2

The procedure for preparation of the coating liquid C-1 in Example 1 was repeated except that the formulation of the coating liquid C-1 was changed to the following formulation for a coating liquid C-2, whereby a coating liquid C-2 was obtained.

| | Parts by Weight |
|---|---|
| Vinyl chloride-vinyl acetate copolymer | 2 |
| 30% water dispersion of carnauba wax (average particle diameter: 4 μm) | 8 |
| Methyl ethyl ketone | 90 |

Preparation of Multiple-use Thermal Image Transfer Recording Medium No. 2

The procedure for preparation of the multiple-use thermal image transfer recording medium No. 1 in Example 1 was repeated except that the coating liquid C-1 employed in Example 1 was replaced by the above prepared coating liquid C-2, whereby a multiple-use thermal image transfer recording medium No. 2 according to the present invention was obtained.

EXAMPLE 3

Preparation of Coating Liquid A-2

The following components were placed in a sand mill vessel, and dispersed at 120° C., so that a coating liquid A-2 constituting a thermofusible ink component was obtained.

| | Parts by Weight |
|---|---|
| Carbon black | 20 |
| Lanolin monoglyceride (melting point: 73° C.) | 30 |
| Candelilla wax | 30 |

-continued

| | Parts by Weight |
|---|---|
| Oxidized polyethylene wax (softening point: 106° C.) | 20 |

The melt viscosity at 110° C. of the above thermofusible ink component was 4,000 cps.

Preparation of Multiple-use Thermal Image Transfer Recording Medium No-3

The procedure for preparation of the multiple-use thermal image transfer recording medium No. 1 in Example 1 was repeated except that the coating liquid A-1 employed in Example 1 was replaced by the above prepared coating liquid A-2, whereby a multiple-use thermal image transfer recording medium No. 3 according to the present invention was prepared.

EXAMPLE 4

Preparation of Coating Liquid A-3

The following components were placed in a sand mill vessel, and dispersed at 110° C., so that a coating liquid A-3 constituting a thermofusible ink component was obtained.

| | Parts by Weight |
|---|---|
| Carbon black | 16 |
| Lanolin monoglyceride (melting point: 73° C.) | 15 |
| Candelilla wax | 9 |
| Microcrystalline wax (melting point: 83° C.) | 50 |
| Ethylene-vinyl acetate copolymer (melt flow rate: 400 g/10 min) | 10 |

The melt viscosity at 110° C. of the above thermofusible ink component was 22,000 cps.

Preparation of Multiple-use Thermal Image Transfer Recording Medium No. 4

The procedure for preparation of the multiple-use thermal image transfer recording medium No. 1 in Example 1 was repeated except that the coating liquid A-1 employed in Example 1 was replaced by the above prepared coating liquid A-3, whereby a multiple-use thermal image transfer recording medium No. 4 according to the present invention was prepared.

EXAMPLE 5

Preparation of Coating Liquid A-4

The procedure for preparation of the coating liquid A-1 in Example 1 was repeated except that the formulation of the coating liquid A-1 was changed to the following formulation for a coating liquid A-4, whereby a coating liquid A-4 constituting a thermofusible ink component was obtained.

| | Parts by Weight |
|---|---|
| Carbon black | 10 |
| Lanolin monoglyceride (melting point: 73° C.) | 30 |
| Candelilla wax | 53 |
| Ethylene-vinyl acetate copolymer (melt flow rate: 900 g/10 min) | 7 |

The melt viscosity at 110° C. of the above thermofusible ink component was 5,600 cps.

Preparation of Multiple-use Thermal Image Transfer Recording Medium No. 5

The procedure for preparation of the multiple-use thermal image transfer recording medium No. 1 in Example 1 was repeated except that the coating liquid A-1 employed in Example 1 was replaced by the above prepared coating liquid A-4, whereby a multiple-use thermal image transfer recording medium No. 5 according to the present invention was prepared.

EXAMPLE 6

Preparation of Coating Liquid B-2

The following components were placed in a sand mil vessel, and dispersed at 110° C., so that a coating liquid B-2 constituting a thermofusible ink component was obtained.

| | Parts by Weight |
|---|---|
| Carbon black | 10 |
| Candelilla wax | 30 |
| Lanolin monoglyceride | 60 |

Preparation of the Multiple-use Thermal Image Transfer Recording Medium No. 6

The procedure for preparation of the multiple-use thermal image transfer recording medium No. 1 was repeated except that the coating liquid B-1 employed in Example 1 was replaced by the above prepared coating liquid B-2, and that the coating liquid B-2 was coated on the first thermofusible ink layer by hot melt coating, whereby a multiple-use thermal image transfer recording medium No. 6 according to the present invention was prepared.

A cross section of the above obtained multiple-use thermal image transfer recording medium No. 6 was observed by a transmission-type electron microscope (TEM). As a result, it was confirmed that an uniform thermofusible ink layer was formed containing finely-divided particles of carbon black therein without any other particles.

EXAMPLE 7

Preparation of Coating Liquid B-3

The procedure for preparation of the coating liquid B-1 in Example 1 was repeated except that the mixture of methyl ethyl ketone and toluene at a mixing ratio of (2:1) employed in Example 1 was replaced by a mixture of methyl ethyl ketone and toluene at a mixing ratio of (1:2), whereby a coating liquid B-3 constituting a thermofusible ink component was prepared. The average particle diameter of the particles of the thermofusible material contained in the coating liquid B-3 was 1.2 μm.

Preparation of Multiple-use Thermal Image Transfer Recording Medium No. 7

The procedure for preparation of the multiple-use thermal image transfer recording medium No. 1 in Example 1 was repeated except that the coating liquid B-1 employed in Example 1 was replaced by the above prepared coating liquid B-3, whereby a multiple-use thermal image transfer recording medium No. 6 according to the present invention was prepared.

EXAMPLE 8

Preparation of Coating Liquid B-4

The procedure for preparation of the coating liquid B-1 in Example 1 was repeated except that the mixture of methyl ethyl ketone and toluene at a mixing ratio of (2:1) employed in Example 1 was replaced by methyl ethyl ketone only, whereby a coating liquid B-4 containing a thermofusible ink component was prepared. The average particle diameter of the particles of the thermofusible material contained in the coating liquid B-4 was 9.7 μm.

Preparation of Multiple-use Thermal Image Transfer Recording Medium No.8

The procedure for preparation of the multiple-use thermal image transfer recording medium No. 1 in Example 1 was repeated except that the coating liquid B-1 employed in Example 1 was replaced by the above prepared coating liquid B-4, whereby a multiple-use thermal image transfer recording medium No.8 according to the present invention was prepared.

COMPARATIVE EXAMPLE 1

Preparation of Comparative Coating Liquid D

The following components were placed in a sand mill vessel, and dispersed at 110° C., so that a comparative coating liquid D constituting a thermofusible ink component was obtained.

| | Parts by Weight |
|---|---|
| Carbon black | 12 |
| Lanolin monoglyceride (melting point: 73° C.) | 30 |
| Candelilla wax | 28 |
| Microcrystalline wax (melting point: 83° C.) | 20 |
| Ethylene-vinyl acetate copolymer (melt flow rate: 2,500 g/10 min) | 10 |

The melt viscosity at 110° C. of the above thermofusible ink component was 10,000 cps.

Preparation of Comparative Multiple-use Thermal Image Transfer Recording Medium No. 1

One surface of a PET film with a thickness of 4.5 μm, serving as a support, was treated so as to have a heat resistance. The aforementioned comparative coating liquid D was coated on the treated surface of the PET film by hot-melt coating, so that a thermofusible ink layer in a coating amount of 7 g/m$^2$ was formed on the heat-resistant support.

Subsequently, the coating liquid C-2 employed in Example 2 was coated on the above prepared thermofusible ink layer using a bar coater, so that a porous resin layer in a coating amount of 0.3 g/m$^2$ was formed on the thermofusible ink layer.

Thus, a comparative multiple-use thermal image transfer recording medium No. 1 was obtained.

COMPARATIVE EXAMPLE 2

Preparation of Comparative Coating Liquid E

The following components were mixed to prepare a comparative coating liquid E.

| | Parts by Weight |
|---|---|
| Carbon black | 10 |
| Candelilla wax | 30 |
| Lanolin monoglyceride | 60 |

Preparation of Comparative Multiple-use Thermal Image Transfer or Recording Medium No. 2

The procedure for preparation of the comparative multiple-use thermal image transfer recording medium No. 1 in Comparative Example 1 was repeated except that the coating liquid D employed in Comparative Example 1 was replaced by the above prepared coating liquid E, whereby a comparative multiple-use thermal image transfer recording medium No. 2 was prepared.

COMPARATIVE EXAMPLE 3

Preparation of Comparative Coating Liquid F

The following components were mixed to prepare a coating liquid F for an adhesive layer.

| | Parts by Weight |
|---|---|
| Ethylene-vinyl acetate copolymer (melt flow rate: 300 g/10 min) | 8 |
| Toluene | 92 |

Preparation of Comparative Multiple-use Thermal Image Transfer Recording Medium No. 3

One surface of a PET film with a thickness of 4.5 μm serving as a support, was treated so as to have heat resistance. The aforementioned coating liquid F was coated on the treated surface of the PET film using a bar coater. so that an adhesive layer in a coating amount of 1.0 g/m$^2$ was formed on the heat-resistant support.

Subsequently, the coating liquid E employed in Comparative Example 2 was coated on the above prepared thermofusible ink layer by a hot melt coating, so that a thermofusible ink layer in a coating amount of 6 g/m$^2$ was formed on the adhesive layer.

Thus, a comparative multiple-use thermal image transfer recording medium No. 3 was obtained.

COMPARATIVE EXAMPLE 4

Preparation of Comparative Multiple-use Thermal Image Transfer Recording Medium No. 4

The coating liquid C-1 employed in Example 1 was coated on the thermofusible ink layer of the comparative multiple-use thermal image transfer medium No. 3 prepared in Comparative Example 3 in the same manner as in Example 1, whereby a comparative multiple-use thermal image transfer recording medium No. 4 was obtained.

COMPARATIVE EXAMPLE 5

Preparation of Coating Liquid G 20 parts of by weight of the coating liquid A-1 employed in Example 1 were pulverized. 80 parts by weight of a mixture of methyl ethyl ketone and toluene with a mixing ratio of (2:1) were added to the above dispersion, and the mixture was dissolved with the application of heat thereto. Subsequently, the mixture was cooled, and dispersed at 23° C. for 24 hours, whereby a coating liquid G was obtained. The average particle diameter of the thermofusible material in the form of finely-divided particles in the coating liquid G was 5.2 μm.

Preparation of Comparative Multiple-use Thermal Image Transfer Recording Medium No. 5

One surface of a PET film with a thickness of 4.5 μm, serving as a support, was treated so as to have heat resistance. The coating liquid B-2 employed in Example 6 was coated on the treated surface of the PET film by hot melt coating, so that a first thermofusible ink layer in a coating amount of 3 g/m$^2$ was formed on the heat-resistant support.

Subsequently, the aforementioned coating liquid G was coated on the above prepared first thermofusible ink layer using a bar coater, so that a second thermofusible ink layer in a coating amount of 4 g/m$^2$ was formed on the first thermofusible ink layer.

The coating liquid C employed in Example 1 was coated on the above prepared second thermofusible ink layer in the same manner as in Example 1, so that a porous resin layer in a coating amount of 0.3 g/m$^2$ was formed on the second thermofusible ink layer.

Thus, a comparative multiple-use thermal image transfer recording medium No. 5 was obtained.

Of the above obtained multiple-use thermal image transfer recording media Nos. 1 to 8 and the comparative multiple-use thermal image transfer recording media Nos. 1 to 5, the melt viscosity of the thermofusible ink component contained in the first thermofusible ink layer (A), the melt viscosity of the thermofusible ink component contained in the second thermofusible ink layer (B), the ratio (A)/(B) of the melt viscosity of the first thermofusible ink layer and that of the second thermofusible ink layer, and the average particle diameter of the thermofusible material in the form of finely-divided particles contained in the thermofusible ink layer which is in contact with the porous resin layer are shown in the following Table 1:

TABLE 1

| | Melt Viscosity of Thermofusible Ink Component at 110° C. (cps) | | Viscosity Ratio | Average Particle Diameter of Thermofusible Ink Component |
|---|---|---|---|---|
| | (A) | (B) | (A)/(B) | in (A) (μm) |
| Ex. 1 | 15,000 | 800 | 19 | 5.5 |
| Ex. 2 | 15,000 | 800 | 19 | 5.5 |
| Ex. 3 | 4,000 | 800 | 5 | 5.5 |
| Ex. 4 | 22,000 | 800 | 27.5 | 5.5 |
| Ex. 5 | 5,600 | 800 | 7 | 5.5 |

TABLE 1-continued

| | Melt Viscosity of Thermofusible Ink Component at 110° C. (cps) | | Viscosity Ratio | Average Particle Diameter of Thermofusible Ink Component |
|---|---|---|---|---|
| | (A) | (B) | (A)/(B) | in (A) (μm) |
| Ex. 6 | 15,000 | 800 | 19 | — |
| Ex. 7 | 15,000 | 800 | 19 | 1.2 |
| Ex. 8 | 15,000 | 800 | 19 | 9.7 |
| Comp. Ex. 1 | 10,000 (*) | | — | — |
| Comp. Ex. 2 | 800 (*) | | — | — |
| Comp. Ex. 3 | 800 (*) | | — | — |
| Comp. Ex. 4 | 800 (*) | | — | — |
| Comp. Ex. 5 | 800 | 15,000 | 0.05 | 5.2 |

(*) Melt viscosity of the thermofusible ink component in the single-layered type thermofusible ink layer.

Image formation was conducted in each of the above prepared multiple-use thermal image transfer recording media No. 1 to No. 8 and the comparative multiple-use thermal image transfer recording media No. 1 to No. 5 by use of a line thermal head. The image formation was repeated 6 times by the application of heat to an identical portion of each recording medium under the following conditions:

| | |
|---|---|
| Thermal head: | Line thin-film head type (8 dots/mm) |
| Platen pressure: | 150 gf/cm |
| Peeling angle against image-receiving medium: | 60° |
| Energy applied from thermal head: | 18 mJ/mm$^2$, 15 mJ/mm$^2$ |
| Printing speed: | 5 inch/sec |
| Image-receiving medium: | Coated paper (with a smoothness of 2,000 sec measured in terms of Bekk's smoothness) |
| Printing image: | "CODE 39" parallel bar code (narrow: 2 dots, wide: 6 dots), and 4 solid black areas (6 mm × 7 mm) |

The density of the solid black areas obtained at each time of 1st, 2nd, 3rd, 4th, and 5th printings was measured by Macbeth reflection-type densitometer RD-914. The bar code reading ratio of the bar code images obtained at 1st, 2nd, 3rd, 4th, and 5th was measured by a bar code laser checker "LC2811" (Trademark), made by Symbol Technology Co., Ltd. The results are shown in Table 2:

TABLE 2

| | Image Density (18 mJ/mm$^2$) | | | | | Bar Code Reading Ratio (%) (18 mJ/mm$^2$) | | | | | Image Density (15 mJ/mm$^2$) | | | | | Bar Code Reading Ratio (%) (15 mJ/mm$^2$) | | | | |
|---|---|---|---|---|---|---|---|---|---|---|---|---|---|---|---|---|---|---|---|---|
| | 1 | 2 | 3 | 4 | 5 | 1 | 2 | 3 | 4 | 5 | 1 | 2 | 3 | 4 | 5 | 1 | 2 | 3 | 4 | 5 |
| Ex. 1 | 1.20 | 1.31 | 1.22 | 1.16 | 1.07 | 100 | 100 | 100 | 100 | 100 | 1.16 | 1.25 | 1.25 | 1.18 | 1.10 | 100 | 100 | 100 | 100 | 100 |
| Ex. 2 | 1.23 | 1.30 | 1.20 | 1.11 | 1.02 | 100 | 100 | 100 | 100 | 100 | 1.19 | 1.26 | 1.20 | 1.14 | 1.05 | 100 | 100 | 100 | 100 | 100 |
| Ex. 3 | 1.28 | 1.25 | 1.21 | 1.03 | 0.80 | 100 | 100 | 100 | 100 | 86 | 1.26 | 1.26 | 1.19 | 1.08 | 0.90 | 100 | 100 | 100 | 100 | 92 |
| Ex. 4 | 1.17 | 1.20 | 1.24 | 1.15 | 1.10 | 100 | 100 | 100 | 100 | 100 | 1.11 | 1.14 | 1.16 | 1.10 | 1.07 | 92 | 100 | 100 | 100 | 100 |
| Ex. 5 | 1.30 | 1.26 | 1.10 | 1.02 | 0.82 | 100 | 100 | 100 | 100 | 86 | 1.25 | 1.25 | 1.13 | 1.04 | 0.88 | 100 | 100 | 100 | 100 | 92 |
| Ex. 6 | 1.04 | 1.12 | 1.24 | 1.18 | 0.99 | 92 | 100 | 100 | 100 | 92 | 1.00 | 1.10 | 1.16 | 1.14 | 1.07 | 80 | 92 | 100 | 100 | 100 |
| Ex. 7 | 1.08 | 1.17 | 1.20 | 1.16 | 1.01 | 92 | 100 | 100 | 100 | 100 | 1.03 | 1.11 | 1.15 | 1.16 | 1.08 | 86 | 100 | 100 | 100 | 100 |
| Ex. 8 | 1.15 | 1.23 | 1.19 | 1.08 | 1.00 | 100 | 100 | 100 | 100 | 100 | 1.13 | 1.21 | 1.21 | 1.14 | 1.07 | 100 | 100 | 100 | 100 | 100 |
| Comp. Ex. 1 | 1.10 | 1.08 | 1.09 | C | C | 100 | 100 | 100 | 0 | 0 | 1.00 | 1.03 | 1.03 | 0.94 | C | 100 | 100 | 100 | 80 | 0 |
| Comp. Ex. 2 | 1.36 | 1.24 | C | C | C | 100 | 92 | 0 | 0 | 0 | 1.28 | 1.25 | 1.03 | C | C | 100 | 100 | 86 | 0 | 0 |
| Comp. Ex. 3 | 1.35 | 1.26 | 1.11 | C | C | 100 | 100 | 100 | 0 | 0 | 1.30 | 1.29 | 1.15 | 1.00 | C | 68 | 86 | 92 | 74 | 0 |
| Comp. | 1.35 | 1.27 | 1.07 | 0.71 | 0.36 | 100 | 100 | 92 | 48 | 0 | 1.29 | 1.31 | 1.10 | 0.82 | 0.51 | 60 | 86 | 86 | 68 | 54 |

TABLE 2-continued

| | Image Density (18 mJ/mm²) | | | | | Bar Code Reading Ratio (%) (18 mJ/mm²) | | | | | Image Density (15 mJ/mm²) | | | | | Bar Code Reading Ratio (%) (15 mJ/mm²) | | | | |
|---|---|---|---|---|---|---|---|---|---|---|---|---|---|---|---|---|---|---|---|---|
| | 1 | 2 | 3 | 4 | 5 | 1 | 2 | 3 | 4 | 5 | 1 | 2 | 3 | 4 | 5 | 1 | 2 | 3 | 4 | 5 |
| Ex. 4 | | | | | | | | | | | | | | | | | | | | |
| Comp. Ex. 5 | 0.91 | 0.92 | 1.00 | 0.93 | 0.88 | 86 | 86 | 92 | 74 | 68 | 0.84 | 0.88 | 0.90 | 0.92 | 0.87 | 74 | 74 | 74 | 86 | 68 |

In the above Table 2, C indicates the complete transfer of the thermal image transfer layer to the image-receiving sheet after an image transfer operation.

The multiple-use thermal image transfer recording medium No. 2 according to the present invention which does not comprise a release agent, as can be seen from the formulation of the porous resin layer coating liquid in Example 2, does not have releasability. The complete transfer of the thermal image transfer layer to an image-receiving sheet was observed in a minute region of the solid black area during a 6th printing operation when the multiple-use thermal image transfer recording medium No. 2 was employed. However, the above-mentioned complete transfer of the thermal image transfer layer to the image-receiving sheet does not present any problems in the practical use of the recording medium. The complete transfer of the thermal image transfer recording layer to the image-receiving sheet was not observed in the other recording media according to the present invention.

Furthermore, the image density and the bar code reading ratio were sufficient for use in practice with respect to the multiple-use thermal image transfer recording media Nos. 1 to 8 according to the present invention. In addition to the above, an excellent image density and image reading ratio were obtained even by the application of a small amount of energy (15 mJ/mm²) particularly in the multiple-use thermal image recording media Nos. 1, 2, 3, 4, 5, 7, and 8 at each of the 1st, 2nd, 3rd, 4th, and 5th operations.

As is apparent from the aforementioned description, the amount of the thermofusible ink component transferred to an image-receiving sheet can uniformly be regulated, so that transferred images with high density can be obtained multiple number of times with almost the same amount of the ink transferred thereto, even after multiple times of the image transfer operations, by use of the first multiple-use thermal image transfer recording medium according to the present invention.

When the porous resin layer has releasability with respect to the thermofusible ink component in the thermal image transfer layer in the first multiple-use thermal image transfer recording medium, the recording medium can easily be separated from an image-receiving sheet after image transfer without the thermal image transfer layer, which remains on the image-receiving sheet when peeled from the support.

Furthermore, by using the second multiple-use thermal image transfer recording medium according to the present invention, the complete transfer of the thermal image transfer layer from the heat-resistant support to an image-receiving sheet can readily be prevented.

By using the porous resin layer of the second multiple-use thermal image transfer recording medium of the present invention, a releasability with respect to the thermofusible ink component in the thermal image transfer layer is obtained, the recording medium can easily be separated from an image-receiving sheet, and images with high density can be obtained at each multiple image transfer operation.

In addition, the thermosensitivity of the first or the second multiple-use thermal image transfer recording medium is increased when the recording medium comprises a thermofusible material in the form of finely-divided particles at least in the thermofusible ink layer which is in contact with the porous resin layer.

What is claimed is:

1. A multiple-use thermal image transfer recording medium comprising:

a heat-resistant support;

a thermal image transfer layer formed on said heat-resistant support, said thermal image transfer layer comprising a plurality of thermofusible ink layers, which is overlaid on said heat-resistant support and comprises a thermofusilbe ink component comprising a coloring agent and a thermofusible material, the melt viscosity of said thermofusible ink component in each of said thermofusible ink layers being in such relationship that the melt viscosity increases toward said heat-resistant support; and a porous resin layer formed on said thermal image transfer layer.

2. The multiple-use thermal image transfer recording medium as claimed in claim 1, wherein said porous resin layer has releasability with respect to said thermofusible ink component in maid thermal image transfer layer.

3. The multiple-use thermal image transfer recording medium as claimed in claim 1, wherein said thermofusible material at least in said thermofusible ink layer which is in contact with said porous resin layer is in the form of finely-divided particles.

4. The multiple-use thermal image transfer recording medium as claimed in claim 3, wherein said thermofusible material in the form of finely-divided particles has an average particle diameter in the range of 1.0 μm to 10.0 μm.

5. The recording medium as claimed in claim 1, wherein the thermofusible ink layers further comprise a viscosity bodying agent.

6. The recording medium as claimed in claim 5, wherein said viscosity bodying agent is a ethylene-vinyl acetate copolymer.

7. The recording medium as claimed in claim 1, wherein the melt viscosity at 110° C. of a first thermofusible ink layer A, which is in contact with said heat-resistant support, is from 1,000 to 300,000 cps.

8. The recording medium as claimed in claim 7, wherein the melt viscosity at 110° C. of a second thermofusible ink layer B, which is in contact with the porous resin layer, is in the range of 100 to 10,000 cps.

9. The recording medium as claimed in claim 8, wherein the ratio of the melt viscosity of layer A to the melt viscosity of layer B is 5 or more.

10. The recording medium as claimed in claim 9, wherein said ratio is from 10 to 30.

11. A multiple-use thermal image transfer recording medium comprising:

a heat-resistant support;

a thermal image transfer layer formed on said heat-resistant support, said thermal image transfer layer comprising a plurality of thermofusible ink layers, which is overlaid on said heat-resistant support and comprises a thermofusible ink component comprising a coloring agent and a thermofusible material, the melt viscosity of said thermofusible ink component in each of said thermofusible ink layers being in such a relationship that the melt viscosity increases toward said heat-resistant support, and said thermofusible ink layer in contact with said heat-resistant support having adhesive properties to said heat-resistant support; and a porous resin layer formed on said thermal image transfer layer.

12. The multiple-use thermal image transfer recording medium as claimed in claim 11, wherein said porous resin layer has releasability with respect to said thermofusible ink component in said thermal image transfer layer.

13. The multiple-use thermal image transfer recording medium as claimed in claim 5, wherein said thermofusible material at least in said thermofusible ink layer which is in contact with said porous resin component is in the form of finely-divided particles.

* * * * *

UNITED STATES PATENT AND TRADEMARK OFFICE

CERTIFICATE OF CORRECTION

PATENT NO. : 5,336,548

DATED : August 9, 1994

INVENTOR(S) : Shiokawa et al.

It is certified that error appears in the above-indentified patent and that said Letters Patent is hereby corrected as shown below:

Column 1, line 42, "an ink layers can be" should read --an ink layer can be--.

Column 4, line 67 "in each of the thermofusible ink layer" should read --in each of the thermofusible ink layers--.

Column 9, line 25 "observing The cross" should read --observing the cross--.

Column 9, line 29 "particles sizes" should read --particle sizes--.

Column 10, line 22 "layer is formed" should read --layer 4 is formed--.

Column 14, line 43 "confirmed that an uniform" should read --confirmed that a uniform--.

Column 16, line 38 "bar coater." should read --bar coater,--.

UNITED STATES PATENT AND TRADEMARK OFFICE

CERTIFICATE OF CORRECTION

PATENT NO. : 5,336,548

DATED : August 9, 1994

INVENTOR(S) : Shiokawa et al.

It is certified that error appears in the above-indentified patent and that said Letters Patent is hereby corrected as shown below:

Column 16, line 62 "20 parts of by weight of-- should read --20 parts by weight of--.

Column 20, line 37 "in maid thermal" should read --in said thermal--.

Signed and Sealed this

Twenty-first Day of May, 1996

Bruce Lehman

*Attest:*

BRUCE LEHMAN

*Attesting Officer*

*Commissioner of Patents and Trademarks*